United States Patent [19]

Braley

[11] 4,436,046

[45] Mar. 13, 1984

[54] ICE-BREAKING HULL

[76] Inventor: William W. Braley, 21 Arrowhead Trail, Media, Pa. 19063

[21] Appl. No.: 344,360

[22] Filed: Feb. 1, 1982

[51] Int. Cl.[3] ..... B63B 35/12; B63B 35/08

[52] U.S. Cl. ..... 114/42; 114/40

[58] Field of Search ..... 114/40, 41, 42; 405/61, 405/217

[56] References Cited

U.S. PATENT DOCUMENTS

| | | | |
|---|---|---|---|
| 77,366 | 4/1868 | Flannigain | 114/41 |
| 857,766 | 6/1907 | Strangebye | 114/41 |

FOREIGN PATENT DOCUMENTS

| | | | |
|---|---|---|---|
| 2212145 | 9/1973 | Fed. Rep. of Germany | 114/40 |
| 2823072 | 11/1979 | Fed. Rep. of Germany | 114/40 |
| 38008 | 10/1923 | Norway | 114/41 |

*Primary Examiner*—Trygve M. Blix
*Assistant Examiner*—Rodney Corl
*Attorney, Agent, or Firm*—Robert S. Lipton; Joseph A. Biela

[57] ABSTRACT

An icebreaker hull is disclosed having cutting edges and sloping ramps that substantially surround the icebreaker's forefoot and taper as they continue aft along the sides of the hull. The cutting edges produce grooves in the underside of the ice to reduce the resistance of the ice to breaking. The ramps are used to break the ice near the bow of the icebreaker and to remove the broken pieces from the water. The pieces of broken ice move along the sloping ramps as the icebreaker continues its forward movement through the ice field. The tapered portions of the ramps provide for the broken pieces of ice to be deposited substantially in windrows on the surface of the unbroken ice field. Thereafter, sweep assemblies that extend away from the hull on both the port and starboard sides are positioned to move the windrows further away from the substantially ice-free channel that is formed behind the icebreaker as it moves forward through the ice field.

12 Claims, 15 Drawing Figures

ICE-BREAKING HULL

BACKGROUND OF THE INVENTION

1. Field of the Invention

This invention relates to ice-breaking ships in general, or, specifically, to ships having hulls that are adapted to break ice for the purpose of forming substantially ice-free channels through ice fields.

2. Description of the Prior Art

The prior art presents many concepts for the design of ice breaking hulls. For example, icebreaker hulls have been disclosed in the following U.S. Pat. Nos.: 17,209, issued May, 1857 to Estlack; 151,774, issued June, 1874 to Grant; 593,664, issued November, 1897 to Inman; 812,656, issued February, 1906 to Julhe; 857,766, issued June, 1907 to Stangebye; 3,636,904, issued January, 1972 to Blanchet; 3,850,125, issued November, 1974 to Anders; and 3,934,529, issued January, 1976 to Gallagher.

Over the years, many icebreaker designs have appeared. These designs have included features to permit plowing, pounding, sawing, or combinations thereof. Recently, patents have been granted for icebreaker hulls having explosive-type features and those that produce bending of the ice sheet by inducing and/or regulating the pitching motion of the breaker. The eight U.S. patents previously cited, are representative of such designs and maneuvers. Of these, only three (U.S. Pat. Nos. 17,204, 151,774, and 857,766) disclose removing large portions of the broken ice from the water. U.S. Pat. Nos. 17,204 and 151,774 involve adjustable, removable attachments for merchant ship hulls; 857,766 discloses a structure that is integral with the hull of a ship. However, defining the limitations of these disclosed invention is difficult since no model or full scale tests appear to have been conducted.

The most successful design, and that currently used throughout the world, is typified by the newest U.S. Coast Guard icebreakers of the "Polar Star" class. The following principal features are characteristic of this type of ship:

a. A length-to-beam ratio of about 4:1;

b. A flared hull from bow-to-stern;

c. The maximum beam located up to about $\frac{1}{3}$ of the total length of the ship, measured from the stem, aft; and d. A highly raked stem particularly below the water line.

Contemporary ice breaking is performed by icebreakers in two principal modes:

a. The continuous mode in which the ship is driven forward through the ice at varying speeds (restrained only by the ice resistance), but during which forward movement is never totally impeded. The severely-raked stem and flared forebody rise partially on the ice sheet, crush the ice under the forefoot, and move through the broken ice that remains. This process is repeated continuously.

b. The ramming mode results when the icebreaker encounters ice of such thickness that forward motion cannot be maintained continuously and the ship comes to a stop after having crushed the ice under her forefoot. (Occasionally the ship may be partially beached on the unbroken ice with a portion of the forebody resting on the unbroken ice.) The ship, in such situations, is backed away from the ice an appropriate distance and then again moved forward against the ice. However, moving the breaker away from a beached position is often a difficult and tedious task which may include providing list and trim changes or assistance from other ships.

In current conventional icebreaker designs and maneuvers, substantially all broken ice remains in the water. Inasmuch as the largest pieces of broken ice that remain in the water may be of considerable size and weight, they continue to provide a hazard to the icebreaker hulls, propellers, and rudders. Smaller pieces of ice tend to move under the hulls to clog underwater hull openings such as sea chests and thruster ports.

The friction produced by movement of the ship's hull into the unbroken ice sheet and its snow cover, and through the broken ice that remains in the channel, as well as the additional energy required to overturn some chunks of ice, impedes the ship's progress and maneuverability.

Furthermore, the broken pieces of ice that are allowed to remain in the channel may refreeze and create additional work for the icebreaker to perform. If the ice pieces are allowed to refreeze in the channel, smaller icebreakers and other ships may continue to be vulnerable to the hazards produced by the ice-obstructed channel.

In addition to clearing a channel having a width equal to the width of the ship's beam, an icebreaker is often called upon for other duties such as channel widening, removing floating ice chunks, providing turnout points and turning basins, and harbor clearing. When required to perform these functions, contemporary icebreakers operate inefficiently due to the broken pieces of ice that remain in the water. The broken pieces of ice are even more hazardous to a ship that is backing and turning and otherwise maneuvering through the pieces of ice.

The conventional icebreaker, in use today, moves through the ice causing major radial cracks in the ice with the bow of the icebreaker. As the ship moves forward in the ice field, the shoulders of the bow and the forefoot, crush, turn, and submerge the ice in the water alongside the stem. Some ice may be deposited on the ice sheet, but much of the ice accumulates between the ship and the ice sheet and below the ship and below the ice sheet. Therefore, even though a channel has been made in the ice field, substantially all of the broken ice moves back into the channel behind the icebreaker and impedes the maneuverability of any other ship that may attempt to move through the channel formed by the icebreaker.

SUMMARY OF THE INVENTION

An icebreaker, in accordance with the invention, forms substantially ice-free channels through ice masses. Ramps, rigidly connected to the hull of the icebreaker, have sloped surfaces to facilitate the movement of the broken ice fragments out of the water and are predeterminedly contoured to deposit the ice fragments on the remaining ice mass on either side of the channel. Cutting edges, molded to the ramps and along the hull at the bow, facilitate in breaking a portion of the ice mass into strips of ice fragments.

The ramp cutting edges, raised above the sloping surfaces of the ramps, provide for the movement of the ice fragments along the ramps until deposited on the ice mass. Sweep means are used to move the deposited ice fragments further away from the substantially ice-free channel formed by the icebreaker.

An object of this invention is to remove ice fragments from the water to form a substantially ice-free channel.

An additional object of this invention is to deposit the ice fragments on top of the remaining ice mass on either side of the channel.

A further object of this invention is to move the deposited ice further away from the channel formed by the icebreaker to prevent the fragments from returning to the substantially ice-free channel.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

BRIEF DESCRIPTION OF THE DRAWINGS

Other objects and advantages of the invention will become apparent upon reading the following detailed description and upon reference to the drawings in which like numerals refer to like parts and in which.

DESCRIPTION OF THE PREFERRED EMBODIMENT

FIGS. 1, 2, 3*a*, and 4 show the forebody of hull 10 of a ship, specifically the hull of an icebreaker. The icebreaker, generally, uses its hull at the stem to break up an ice field into pieces and fragments of ice. In this embodiment, rigidly connected to and substantially surrounding the hull at stem 12, about forefoot 40, are ramps 16*a* and 16*b*, predeterminedly contoured to have negative and positive sloping surfaces 18*a*, 18*b*, and 20*a*, 20*b*, respectively, lower serrated outboard and inboard cutting edges 22*a*, 22*b*, 22*c*, and 22*d*, guide rails 24 molded substantially parallel to one another on said positive sloping surfaces, sponsons 26*a* and 26*b* extending outboard and angling downward from hull 10 and merging with ramps 16*a* and 16*b*, as said ramps taper from forefoot 40, aft. Ramps 16*a* and 16*b* have been contoured to remove the ice fragments and pieces from the water, and to deposit these fragments and pieces on the ice that remains unbroken on either side of the channel formed by the forward movement of the icebreaker. In addition to lifting the ice fragments from the water and depositing them on the solid ice on either side of the ship, the deposited ice fragments are swept laterally away from about the port and starboard sides of the ship to prevent them from sliding back into the water and clogging the substantially cleared channel. The icebreaker is able to form a substantially ice-free channel by preventing the broken pieces of ice from re-entering the water behind the icebreaker. This is accomplished by movable sweep assemblies 28*a* and 28*b* which are made to extend laterally outward from hull 10 by movement of boom 30*a* and boom 30*b*, respectively.

Figure 4:
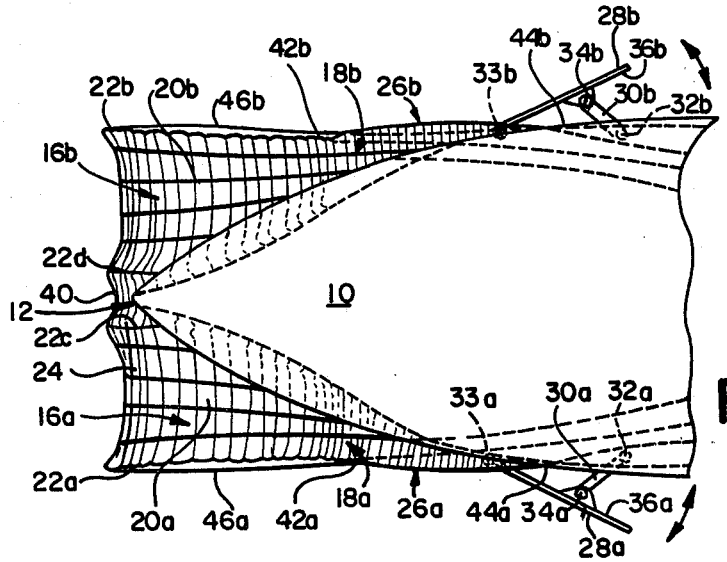
FIG. 4 is a partial top planar view along line 4—4 of FIG. 2 showing the bow of an icebreaker in accordance with the invention.

Operation of sweep assembly 28*a* will now be described. Of course, sweep assembly 28*b* operates in substantially the identical manner. As shown in FIG. 4, boom 30*a* is rotatably connected to first stationary king post 32*a* and pivotally connected to sliding slipper 34*a*. First stationary king post 32*a* is secured to hull 10 and slipper 34*a* is slideably connected to inboard surface 36 of movable sweep assembly 28*a*. The movable sweep assembly can arcuately swing away from its housed position in the side of hull 10, by pivoting one end of boom 30*a* about king post 32*a* and by sliding the other end of boom 30*a* along inboard surface 36*a* via slipper 34*a*, to substantially any lateral distance from the side of the ship restrained only by the length of boom 30*a* and the sliding distance provided on inboard surface 36*a* of the movable sweep assembly. Movable sweep assembly 28*a* also pivots at one end about stationary pivot post 33*a* as the opposite end arcuately moves away from hull 10. Movable sweep assembly 28*a* is positioned with respect to the elevation of the unbroken ice on either side of the ship so as to move the ice pieces and fragments, that are deposited on the unbroken ice, further away from the substantially ice-free channel that is formed behind the icebreaker as it moves forward through the ice field. Sweep assembly 28*b* is positioned on the starboard side in generally the same manner.

As the ship enters an ice field, the ice is broken up into pieces and fragments in substantially the following way. Serrated outboard and inboard cutting edges 22*a*, 22*b*, 22*c*, and 22*d* engage the submerged underside of the ice. As the ship moves forward into the ice, the serrated cutting edges cut into the ice, substantially in the manner of a saw cutting into wood, thus producing grooves in the underside of the ice. FIG. 2 shows how the serrated edges meet the underside of the ice, depending upon the depth of the ice, for the purpose of cutting into the ice. Forming grooves in the ice affects the ease with which the ice is subsequently broken up in at least two ways. First, putting grooves in the ice reduces the overall strength of the ice about the ships forefoot. The effect is similar to perforating a piece of paper before tearing it along the perforation. The perforation reduces the resistance of the paper to be torn along the perforation. Second, the ice may easily be broken substantially along the grooves as ramps 16*a* and 16*b* are forced along the underside of the ice as the ship moves forward in the water. As the icebreaker advances further into the ice, upper serrated cutting edge 38, provided along the ship's stem, substantially forming a v-shaped wedge with respect to the lower serrated cutting edges, just below the point of the bow, engages the upper surface of the ice. The ice now lies in a substantially scissor-like grip between the upper and lower serrated cutting edges as shown in FIG. 1. As the ship moves forward through the ice field, the lower serrated cutting edges continue to saw into the underside of the ice, while the upper serrated cutting edge provides a scissor-like cutting effect with respect to the lower cutting edges, on the top surface of the ice.

Figure 1A:
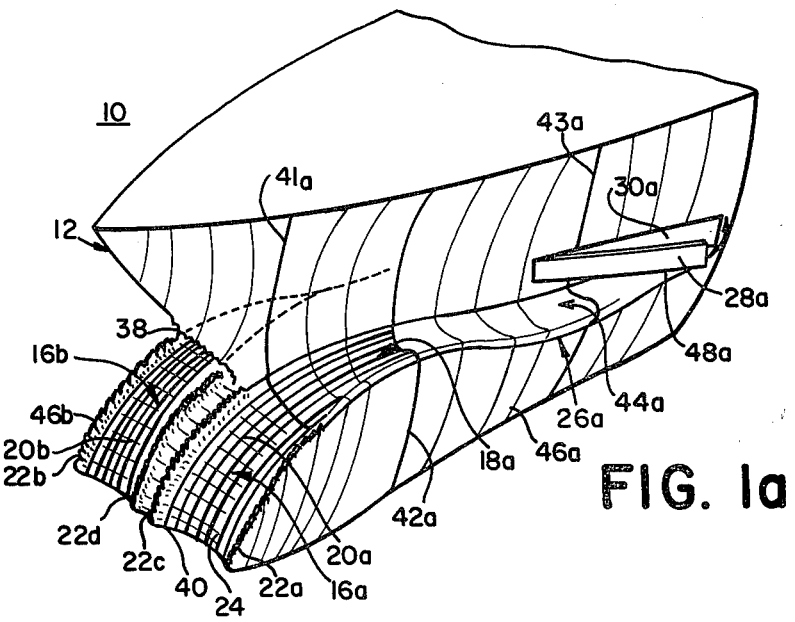
FIGS. 1*a* and 1*b* are partial perspective views from the port bow of an icebreaker in accordance with the invention.
Figure 1B:
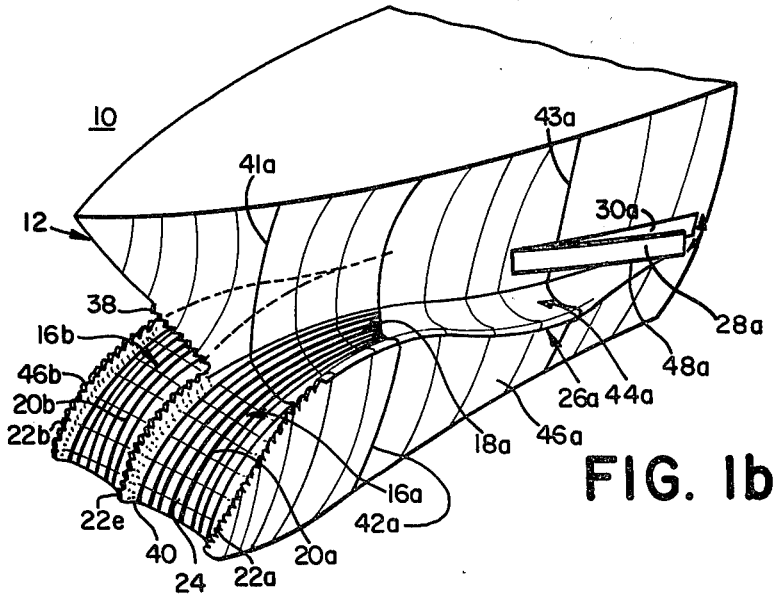
Figure 2:
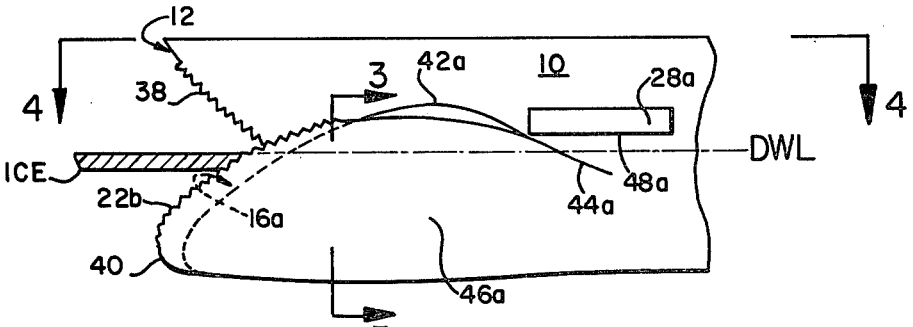
FIG. 2 is a partial planar view of the port side of an icebreaker in accordance with the invention.

As is shown in FIG. 1*a* the scissor-like cutting action is accomplished by the two lower serrated cutting edges 22*d* and 22*c* acting with the upper serrated cutting edge 38. The upper serrated cutting edge 38 is positioned between the spaced lower serrated cutting edges 22*d* and 22*c*, thus permitting the ice to be broken by a bonding action in addition to a compression between the upper and lower serrated cutting edges. The upper and lower serrated cutting edges in the embodiment shown in FIG. 1*b* are in the same vertical plane and thus act, primarily, by compression.

The ice, within close proximity to the bow of the ship, is broken into pieces and fragments which are carried along each ramp 16*a* and 16*b*, substantially in the region extending from front portion 40 to no-slope portions 42*a* and 42*b*. Generally, after the ice is broken up, the pieces move along the ramps generally from front portion 40 to tapered portions 44*a* and 44*b* as the ship moves forward in its channel and are deposited on the top surface of the unbroken ice on either side of the ship's hull. Deposition of ice generally occurs between no-slope portions 42*a* and 42*b*, and tapered portions 44*a* and 44*b* of ramps 16*a* and 16*b*, respectively. Sweep assemblies 28*a* and 28*b* are positioned, as previously described, to provide for the movement of ice pieces and fragments laterally, away from the ship's hull, on top of the unbroken ice, so as to prevent the broken ice from sliding back into the substantially ice-free channel as the ship continues its forward movement through the ice field. Sweep assembly 28*b* also arcuately moves away from hull 10 by pivoting about stationary pivot post 33*b* as is shown in FIG. 4.

Hull 10 is shaped substantially convex from the bow of the ship to a region of the hull 41 forward of the no-slope portion of the ramps. This point 41 may vary according to the particular design of the present invention. Thereafter, the hull is shaped substantially concave to a point 43 along the tapered portions 44*a* and 44*b*. The substantially convex shape of the hull continues aft of 43. The purpose of the concave hull shape region of the ship is to maximize the width of the ramps to encourage the pieces of broken ice to move up the ramps, as the ship progresses through the water, to no-slope portions 42*a* and 42*b* and, from thereaft, to be discharged to the sides of hull 10 onto the unbroken ice as the ice fragments are made to move from the no-slope portions, aft. The entire movement of ice in this manner is similar, in effect, to the movement of snow when a contoured snowplow blade, positioned at an angle, moves forward through the snow. The snow piles slightly at the blades front surface and, due to the blades contour and angular position, is quickly discharged to the side, away from the substantially snow-free channel produced by the snowplow. Also, the forward convex shape of the hull reduces the tendency of the ice or water to force the bow downward.

As the icebreaker moves forward into the ice field, pieces of broken ice move aft along the ramps and the lower outboard cutting edges. Pieces of ice in the shape of ice strips will tend to rest on guide rails 24. Smaller ice fragments tend to accumulate in the area between the lower inboard cutting edges and slightly inboard of the lower outboard cutters. The ice strips are formed as a result of a bending moment that is provided on the underside of the ice as a result of the sloping surfaces of the ramps and cutters. The moment acts vertically upward such that the center of the moment will occur around a transverse axis located at or near the ice surface within close proximity to the point of the bow. As the ship moves forward, the moment increases until the ice fracture transversely near the axis forming ice strips due to the sawing effect produced by the lower cutting edges. As the ship continues through the ice field, strips of ice, smaller ice fragments, and sea water will move along the ramps toward the no-slope portion of each ramp and, thereafter, be deposited on the surface of the unbroken ice.

Passage of the larger strips of ice along the ramps 16*a* and 16*b* is facilitated by guide rails 24. The rails not only aid in directing the flow of ice aft, but also in reducing resistance to movement of ice on the ramps. Since the guide rails are relatively narrow, they localize the pressure due to the force produced by the weight of the ice strips, thereby minimizing the sliding friction between pieces of ice and the ramps. This is similar, functionally, to the use of skate blades or sled runners for movement on ice and snow.

Ice strips and pieces will remain on the ramps as they move out of the water and aft alongside the hull, being restrained by lower outboard cutters, until they approach the no-slope portions of the ramps. Some pieces of ice may fall from the ramps prior to reaching the no-slope portions, but only small pieces and fragments will fall into the water through the gap between the ship's hull and the unbroken ice. Those pieces, presumably larger, that fall from the ramps after reaching the no-slope portions, will fall to the unbroken ice.

Low outboard cutting edges 22*a* and 22*b* are discontinued near the no-slope portion of each ramp where they are generally faired down into the floor of each ramp as each ramp slopes (negative slope) aft. Also, near the no-slope portion of each ramp, sponsons 26*a* and 26*b* extend outboard, down from the floor of ramps 16*a* and 16*b*, respectively, and aft, ending near tapered portions 44*a* and 44*b*, respectively, where both ramps and sponsons are faired into the hull 10. Ramps and sponsons fair into the hull within close proximity to the water line DWL, as shown in FIG. 1*a*. Once the broken ice strips and fragments reach the area of the sponsons, they begin to spill over the sponsons onto the unbroken ice that remains on either side of the hull. Guide rails and cutting edges no longer restrain the ice pieces near the sponsons, thereby allowing the ice pieces that have moved up the ramps to drop to the unbroken ice below the sponsons.

Once the broken pieces of ice have dropped to the unbroken ice that remains on either side of the hull, the icebreaker further disposes of these pieces in the following manner. Movable sweep assemblies 28*a* and 28*b* are housed within the hull on both the port and starboard sides, respectively, of the icebreaker. In the following discussion, only the port side sweep assembly 28*a* will be described. However, the other, starboard side, sweep assembly 28*b* would be constructed and function in substantially the same way. Laterally positioning sweep assembly 28*a* by arcuately moving it, in the manner previously described, away from the ship's hull produces a snowplow-like effect as it provides for the movement of broken pieces of ice that have fallen to the unbroken ice away from the channel formed by the passage of the icebreaker through the ice field. Specifically, as the ship moves forward in the ice, the sweep assembly, when positioned properly, engages the broken pieces of ice that have accumulated on the unbroken ice, after falling from the ramps, for the purpose of moving them further away from the substantially ice-free channel formed by the icebreaker. The sweep assembly is positioned so that bottom edge 48*a* of the assembly 28*a* passes above but within close proximity to the surface of the unbroken ice. Assembly 28*a* may be positioned, with respect to the surface of the unbroken ice, by either varying the list, trim, or draft of the icebreaker itself, or by automatically controlling the radial as well as the angular movement of boom 30*a*. The broken pieces of ice are then substantially prevented from returning to the water in the channel produced by the ship as it proceeds through the ice field.

Figure 3A:
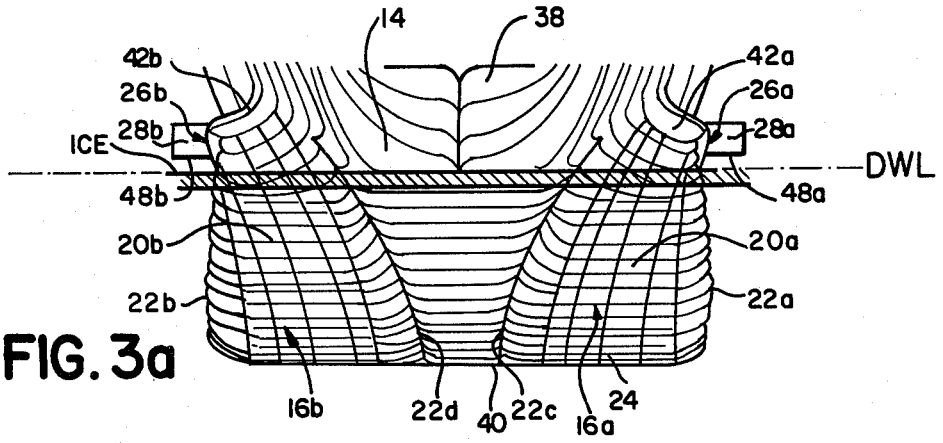
FIGS. 3*a* and 3*b* are partial frontal views along line 3—3 of FIG. 2 showing the forefoot of an icebreaker in accordance with the invention.
Figure 3B:
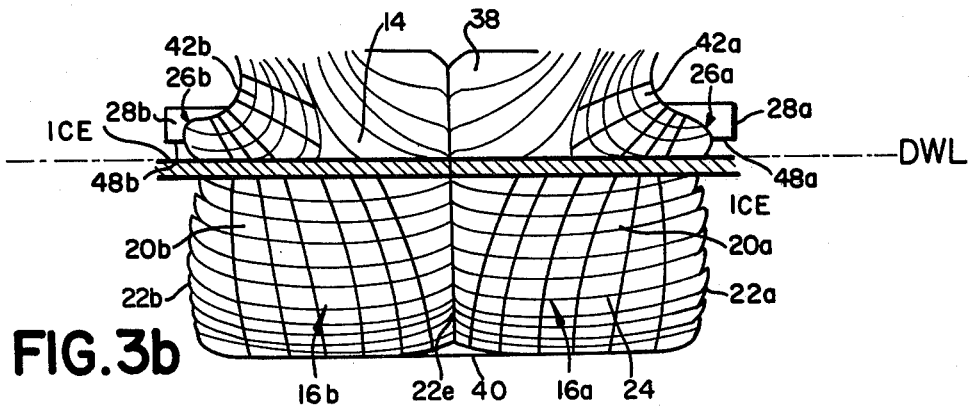

As a further embodiment of the present invention, FIGS. 1*b* and 3*b* show the forebody of hull 10 of an icebreaker having lower serrated inboard and outboard cutting edges 22*a*, 22*b*, and 22*e* molded, as described above, substantially on the positive sloping surfaces of ramps 16*a* and 16*b*. Unlike the prior embodiment that disclosed at least two lower, inboard serrated cutting edges, 22*c* and 22*d*, this present embodiment shows lower, inboard serrated cutting edge 22*e* that may be provided instead of edges 22*c* and 22*d* as can easily be compared between FIGS. 3*a* and 3*b*. The ice breaking effect of having single cutting edge 22*e* is substantially as provided above in the description of an icebreaker hull having ramps with at least two, lower inboard serrated cutting edges.

Figure 5A:
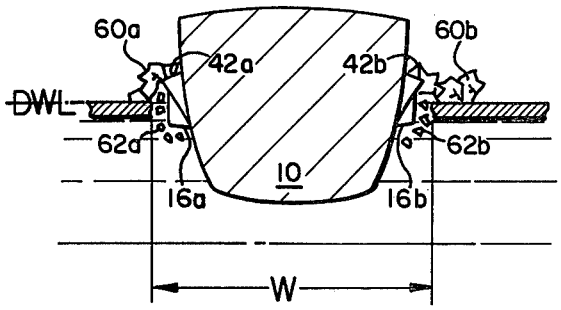
FIG. 5*a* is a transverse cross-section view of an icebreaker clearing a channel without using the sweep assemblies in accordance with the invention.
Figure 5B:
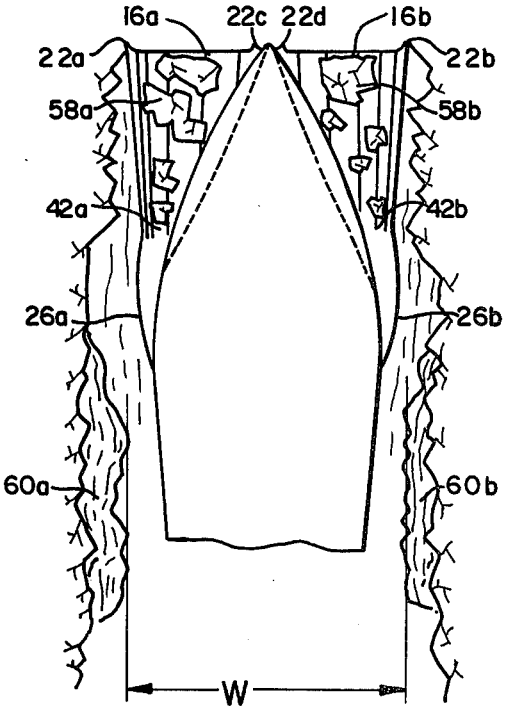
FIG. 5*b* is a partial top planar view of the bow of an icebreaker clearing a channel without using the sweep assemblies in accordance with the invention.

The following are specific examples of how the sweep assemblies may be effectively used during ice breaking operations. Referring to FIGS. 5*a* and 5*b*, and 6*a* and 6*b*, and in accordance with the invention, a substantially ice-free channel, of width w defined by the maximum icebreaker beam width, may be produced through a large ice field. The figures show a ship suitably rigged with ramps and sweep assemblies in accordance with the invention as previously described. FIGS. 5*a* and 5*b* show how the ship engages the ice, breaks it and, as it moves forward, provides for the ice strips and fragments 58*a* and 58*b* to move along ramps 16*a* and 16*b* to be subsequently deposited in windrows 60*a* and 60*b* on the surface of the unbroken ice on either side of ship's hull 10. Also shown are some smaller fragments of ice slipping back into the channel formed by the icebreaker. The sweep assembly has not been extended from the sides of the hull in FIGS. 5*a* and 5*b*.

Figure 6A:
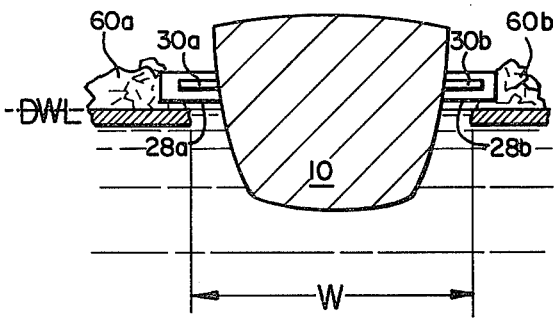
FIG. 6*a* is a transverse cross-section view of an icebreaker clearing a channel in accordance with the invention.
Figure 6B:
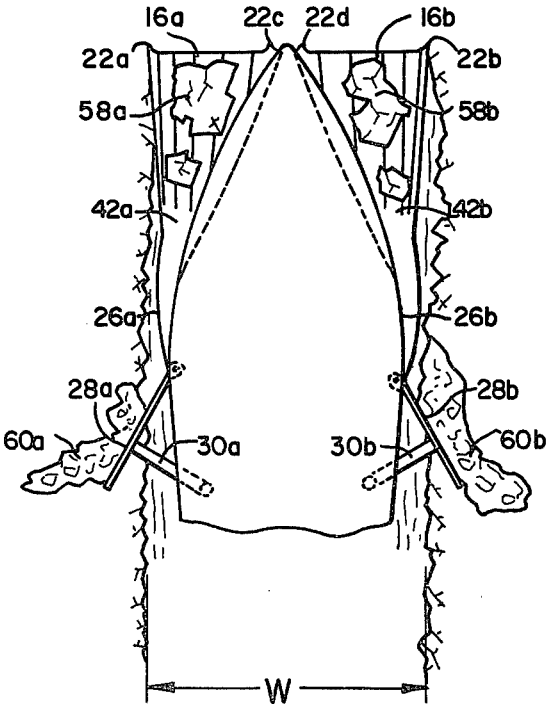
FIG. 6*b* is a partial top planar view of the bow of an icebreaker clearing a channel in accordance with the invention.
Figure 7:
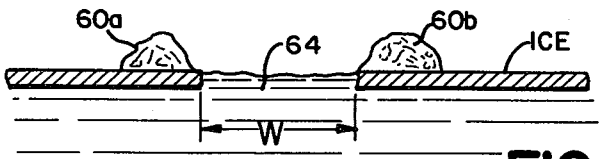
FIGS. 7 through 9*b* are a planar view of an ice field for widening ice-free channels without interference from pieces of ice floating in the channels in accordance with the invention.

FIGS. 6*a* and 6*b* show sweep assemblies 28*a* and 28*b* extended from the sides of hull 10 for the purpose of moving windrows of ice 60*a* and 60*b* further away from the channel, thereby preventing a substantial portion of the broken pieces of ice from moving back into the water and clogging the substantially ice-free channel.

Figure 8A:
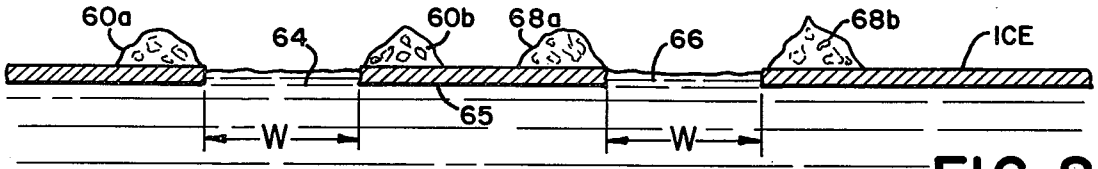
Figure 8B:
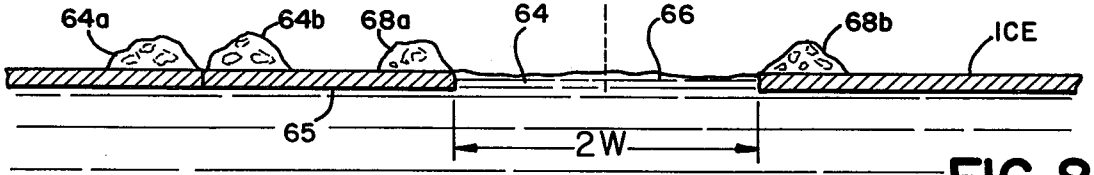
Figure 9A:
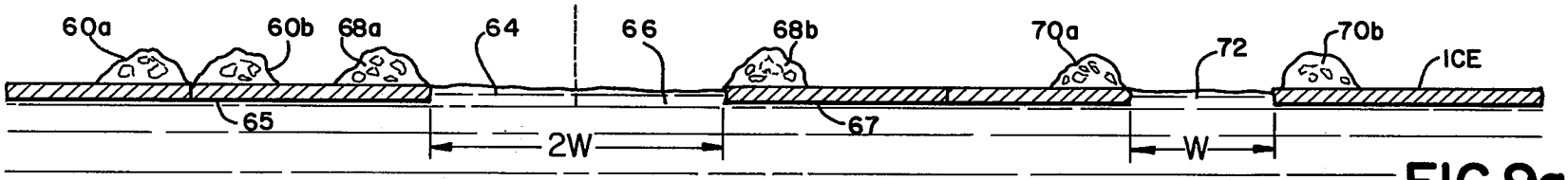
Figure 9B:
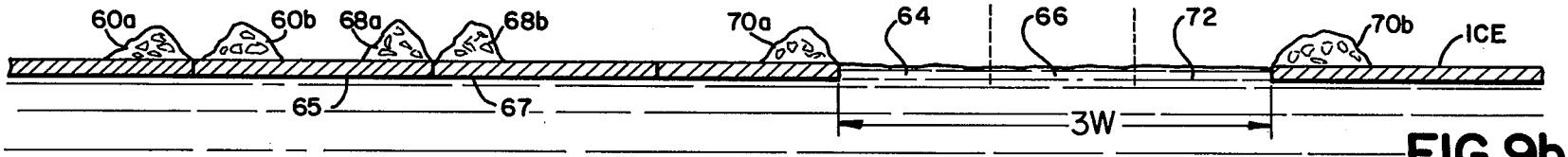

Referring to FIGS. 7, 8*a*, 8*b*, 9*a*, and 9*b*, the procedure for channel widening is shown. An icebreaker rigged in accordance with the invention, removes the broken ice from first channel 64, having width w, and deposits the pieces of ice substantially in windrows 60*a* and 60*b* on either side of channel 64. Upon moving a predetermined distance into the ice field, the icebreaker backs down substantially ice-free clear channel 64. The icebreaker then proceeds to clear a second channel 66, as shown in FIG. 8*a*, in the same manner as it cleared channel 64, leaving behind windrows 68*a* and 68*b* of broken ice. After progressing another predetermined distance while forming the second channel, the icebreaker makes a short turn to the port side to break off ice portion 65, that lies between the first and second channels from the remaining ice field. The ice portion 65 now separated from the remaining unbroken ice field may be, by various maneuvers, moved against a side of the unbroken ice, as shown in FIG. 8*b* to form a channel of width 2*w*. The icebreaker may then continue to form third channel 72 as shown in FIG. 9*a* and, as described above, separate ice portions 67 form the ice field and move it to one side as shown in FIG. 9*b*, thereby forming an even wider channel than could otherwise be formed to the extent of three times the width w of the ship's beam. The icebreaker can continue in this manner, thereby forming wider and wider channels. A channel of width 3*w* would allow for the breaker to turn 180 degrees without having to back out of third channel 72. Notice that windrows 70*a* and 70*b* where deposited on the unbroken ice during the passage of the icebreaker through the ice field while forming the third channel.

Using substantially the procedure described above, the icebreaker, in accordance with the invention, is able to create ice-free channels of any desired length and width, to clear harbors, to make turning basins, and to free other ships caught in ice fields.

The discussion thus far has been about icebreakers operated in a continuous, forward mode. However, an icebreaker, rigged in accordance with the invention may also be used in the ramming mode. The cutting action of the lower outboard and inboard cutting edges would still function as previously described during the ramming mode to allow the breaker to clear a channel without a great risk of beaching of the ship on the ice.

The invention including the ramps and sweep assemblies may be integrated, substantially as disclosed, with the hulls of existing icebreakers as well as used in the construction of new hulls designed purposely to accommodate the features of the invention.

What is claimed is:

1. An icebreaker for forming substantially ice-free channel of water through an ice mass by breaking up a portion of the ice mass into fragments comprising:

a hull, including a forwardly and upwardly sloping stem;

a pair of ramps having first and second longitudinally sloped surfaces rigidly connected to and partially surrounding a portion of said hull for substantially removing said ice fragments from said water and depositing them on the remaining ice mass on either side of said channel, each of said ramps extend forward of said stem and have a longitudinally oriented trough formed by their upper surfaces, cutting edges molded to said stem and to inboard and outboard sides of said ramps which form the sides of said troughs for breaking said ice mass into substantially strips of ice fragments that are removed from the water along said ramps and deposited therefrom on the remaining ice mass on either side of said channel, said stem and cutting edges having an acute angle therebetween, and a pair of longitudinally oriented sweep means, each having a substantially vertical hinge at its leading edge for pivotally connecting it to said hull for moving said deposited ice fragments further away from said substantially ice-free channels.

2. The icebreaker of claim 1 wherein said ramps have a common raised sided member which forms an inner edge of each of said troughs, said raised member having connected thereto one of said cutting edges which forms said inboard cutting edges and which forms an extension of the leading edge of said stem.

3. The icebreaker of claim 2 wherein the inboard side members of said ramps are positioned outboard of the leading edge of said stem and form a third trough therebetween.

4. The icebreaker of claim 2 or 3 in which said ramps include a plurality of guide rails for minimizing the sliding friction between said ice fragments and said ramps to direct and facilitate movement of said ice fragments.

5. The icebreaker of claim 2 or 3 in which said first and second sloped surfaces have positive and negative slopes, respectively, and meet at a no-slope portion of each ramp said no-slope region being positioned rearward of said stem.

6. The icebreaker of claim 5 in which said hull is substantially convex from said bow to within close proximity to said negative slope for maximizing the width of said ramps to facilitate the movement of said ice fragments.

7. The icebreaker of claim 5 in which said hull is substantially concave along a portion of said negative slope of said ramps.

8. The icebreaker of claim 5 in which said ramps include sponsons extending outward and downward from the no-slope portion of each ramp for depositing said ice fragments onto the remaining ice mass on either side of said channel.

9. The icebreaker of claim 5 in which said sweep means are housed within the sides of said hull.

10. The icebreaker of claim 5 in which said ramps are predeterminedly contoured and faired into said hull to facilitate removal of said ice fragments from said water.

11. The icebreaker of claim 2 or 3 in which said cutting edges provide grooves in said ice mass for reducing the strength of said ice mass and making it easier to break by said icebreaker.

12. The icebreaker of claim 11 in which said cutting edges along said ramps are raised above said sloping surfaces for keeping said ice fragments on said ramps until deposited on said remaining ice mass.

* * * * *